United States Patent [19]

Weiss

[11] Patent Number: 4,655,029

[45] Date of Patent: Apr. 7, 1987

[54] METHOD AND APPARATUS FOR FILLING BOTTLES OR THE LIKE WITH LIQUID

[75] Inventor: Wilhelm Weiss, Regensburg, Fed. Rep. of Germany

[73] Assignee: Krones AG Herman Kronseder Maschinenfabrik, Fed. Rep. of Germany

[21] Appl. No.: 788,868

[22] Filed: Oct. 18, 1985

[30] Foreign Application Priority Data

Oct. 31, 1984 [DE] Fed. Rep. of Germany ..... 3439736

[51] Int. Cl.[4] ..... B65B 31/06

[52] U.S. Cl. ..... 53/432; 53/79; 53/403; 53/510; 141/6

[58] Field of Search ..... 53/432, 425, 510, 79, 53/86, 403, 109; 141/6, 5, 9, 105, 70; 426/592, 600, 486

[56] References Cited

U.S. PATENT DOCUMENTS

| | | | |
|---|---|---|---|
| 3,212,537 | 10/1965 | Hinxlage | 141/6 |
| 3,699,740 | 10/1972 | Knabe | 53/432 |
| 3,837,137 | 9/1974 | Yatsushiro et al. | 53/510 X |
| 4,347,695 | 9/1982 | Zobel et al. | 53/432 |

FOREIGN PATENT DOCUMENTS

| | | |
|---|---|---|
| 1910548 | 11/1976 | Fed. Rep. of Germany . |
| 690636 | 4/1953 | United Kingdom . |

*Primary Examiner*—James F. Coan

*Attorney, Agent, or Firm*—Fuller, Puerner & Hohenfeldt

[57] ABSTRACT

A method and apparatus for filling a bottle with an oxygen sensitive liquid such as beer in which the bottle is pre-evacuated, pressurized with pure $CO_2$, over-filled with liquid at constant pressure and then brought back to the proper fill level by injecting pure $CO_2$ and forcing the excess back into the gas pressurized liquid storage tank while the bottle is still coupled to the filling head. After uncoupling, the bottle is transported to under a closure cap applying device at which there are nozzles that project $CO_2$ under the device and over and around the mouth of the bottle so the space even within the cap is purged of air. The $CO_2$ used for purging is adequately free of air since it is taken from the storage tank to which $CO_2$ is returned from the bottles as a result of filling liquid displacing the $CO_2$ gas which is diluted only to the extent that pre-evacuation is not perfect.

7 Claims, 8 Drawing Figures

METHOD AND APPARATUS FOR FILLING BOTTLES OR THE LIKE WITH LIQUID

BACKGROUND OF THE INVENTION

The invention relates to a method and apparatus for filling bottles with liquid and excluding air from the bottles during the filling operation.

One prior art method is disclosed in British Pat. No. 690,636 for filling bottles with an oxygen sensitive liquid such as beer. The bottles are, of course, filled with air when they are coupled to the filling head of the filling machine. They are initially pressurized with $CO_2$ and air mixture so that when the liquid is flowing into the bottle it becomes exposed undesirably to oxygen in the air. Initially, the bottles are usually overfilled with liquid to a level above the tip of a filling tube which extends into the neck of the bottle. To lower the level of the liquid to a level corresponding with the level of the tip of the filling tube, $CO_2$ is injected into the filling head so that liquid is driven out of the bottle by way of the filling tube and back into the liquid storage tank. This results in the space above the liquid containing substantially pure $CO_2$ in the time up to application of a crown sealing cap, for instance. However, some contamination of the liquid has already occurred as the result of the liquid being allowed to mix with residual oxygen in the bottle during the initial filling stage. Moreover, in this prior art apparatus, as is typical in the prior art, the crown caps have air trapped under them as they are pressed onto the bottle, thus introducing additional air to the bottle.

In another prior art filling method for air sensitive liquids as in U.S. Pat. No. 3,212,537, the first step is to draw most of the air out of the bottles. Then a mixture of air and $CO_2$ is drawn out of a tank containing the liquid and pressurized gas and this is introduced into the bottles. Because of the pre-evacuation, air is about 10% of the gaseous mixture, but this portion is increased when the bottle is prefilled with gas because the gas contains at least 10% of air. In this type of prior art filling machine, the gas and air mixture which is injected into the bottle before the liquid is fed in is returned to the storage tank as is commonly done. Pure $CO_2$ is also fed into the tank to make up for losses. Despite adding pure gas, the gas mixture in the tank usually equilibrates with an air content of approximately 10%. After filling the bottle to a predetermined level, a mixture of air and $CO_2$ remains in the space above the liquid. Thus, as is known, before a sealing cap can be applied to the bottle, it is necessary to foam over to eject the harmful air.

In another known filling method, used especially for weakly foaming air sensitive liquids, the bottles are filled to the rim and then transported to a capping device where $CO_2$ is blown under high pressure against the sealing device as in German Laid Out Specification No. 19 10 548. By way of $CO_2$ deflected from the sealing element, which may be a crown cap, a part of the liquid is forced out of the bottle mouth and replaced by $CO_2$. With this known method, it is impossible to control the fill level consistently. Furthermore, the liquid forced from the bottle cannot be collected so there is a high liquid loss. Because of impracticality, no measures are taken to prevent harmful oxygen exposure during the filling of the liquid into the bottle. Use of this method is not widespread as it can be used solely for weakly foaming liquids.

SUMMARY OF THE INVENTION

An object of the invention is to provide a method and apparatus which minimizes exposure of liquid that is being filled into bottles to atmospheric air while at the same time eliminating any liquid loss.

With the new method, all steps in a bottle filling operation are performed under oxygen-poor or oxygen-free conditions so that exposure of the liquid to oxygen is minimized. The bottles are pre-evacuated before they are filled with $CO_2$. It is inevitable that some air remains in the bottle before the filling phase is started. After filling is complete, in accordance with the invention, this portion of air and $CO_2$ mixture is mostly purged from the bottle above the liquid fill level and replaced with practically pure $CO_2$. Before and after the seal, such as a crown cap, is applied to the bottle a $CO_2$ atmosphere is maintained above the bottle. Thus, no opportunity is afforded for the cap to trap air as it is pressed onto the bottle. Liquid is never displaced over the rim of the bottle. Even though there is a prefilling with pure $CO_2$, there is, however, hardly higher consumption of $CO_2$ than with known methods where the $CO_2$ is added to the common tank for the liquid and the pressure gas in order to keep the oxygen concentration low. The $CO_2$ use upon sealing is relatively small since only the air must be forced out of the cavities in the sealing cap and between the sealing cap and bottle mouth.

In the new method, the pressure of the $CO_2$ admitted to the bottle after it is evacuated is just slightly greater than the pressure of the $CO_2$ in the liquid-gas storage tank. Thus, the bottles are filled under substantially constant pressure conditions and the liquid runs simply by the force of gravity from the storage tank to the bottles. In $CO_2$ containing beverages such as beer, mineral water or lemonade the source $CO_2$ pressure can be around 2 to 5 atmospheres. The pressure may be held as low as is necessary for the $CO_2$ to bind with the liquid since no foam-over or blowout step is used between filling and sealing to get the proper liquid level in the bottle.

How the foregoing and other objects of the invention are achieved will be evident in the more detailed description of a preferred embodiment of the invention which will now be set forth in reference to the drawings.

Figure 1:
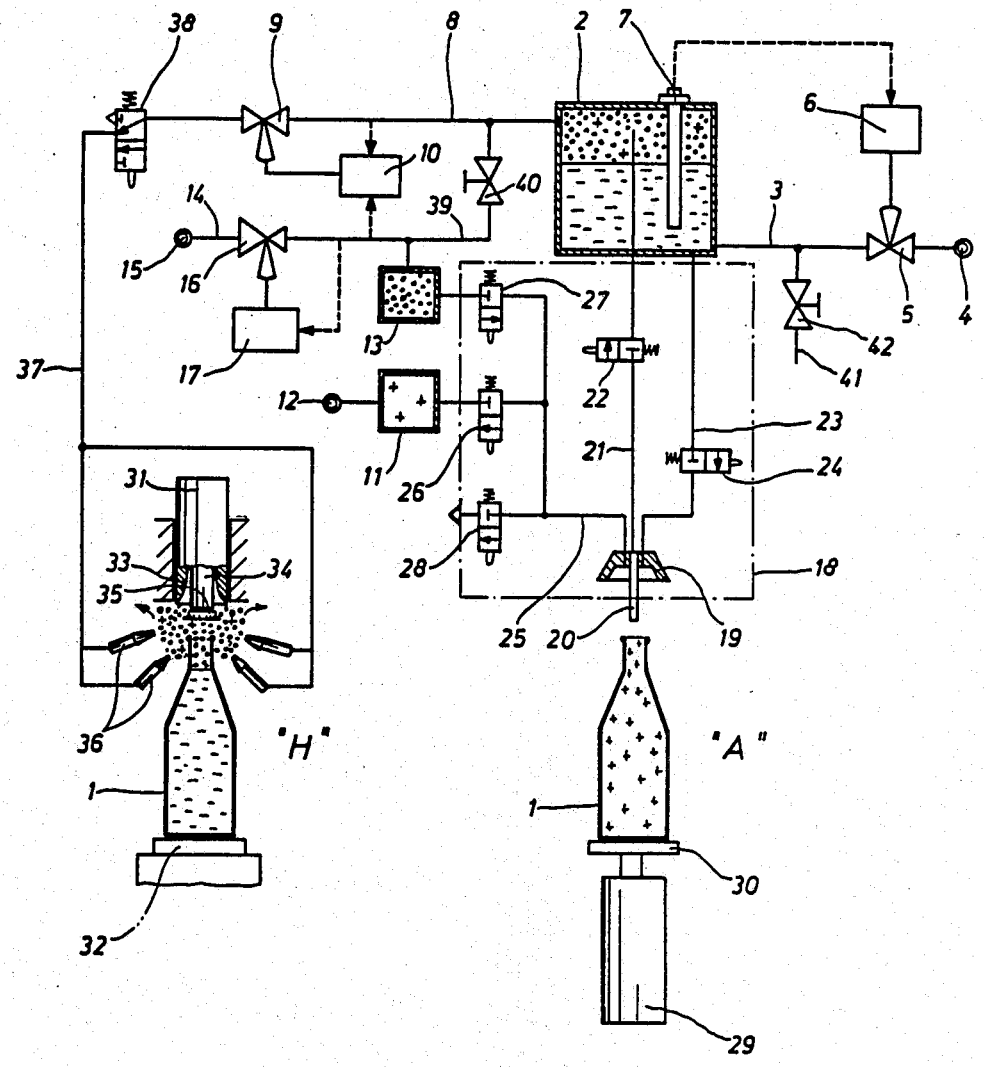
FIG. 1 is a diagrammatic view of a bottle filling system, in accordance with the invention, for filling with an oxygen sensitive liquid such as beer.

The filling system in FIG. 1 is for a strongly foaming oxygen sensitive beverage such as beer. The bottles are marked 1. The apparatus comprises a first pressurized container or tank 2, which is connected by means of a conduit 3 to a source 4 of beer. By way of example, in the present embodiment, the beer may be under a pressure of four bars (atmospheres). Infeed conduit 3 contains a control valve 5 which is controlled by a regulator 6 that responds to signals supplied from a liquid level sensor probe 7. Thus, regulator 6 modulates valve 5 to maintain a predetermined liquid level in pressurized tank 2. The apparatus has a second sealed tank or pressure container 11 which is connected to a vacuum source 12 which is further connected to the inlet of a vacuum pump, not shown. In this example, the second pressure container 11 is evacuated to an absolute pressure of, for example, 0.1 atmosphere. The apparatus has a third pressure container 13 which is connected by means of a conduit 14 to a source 15 of $CO_2$. The pressure of the $CO_2$ source in this example is 5 atmospheres. There is a reducing valve 16 interposed between conduit 14 and conduit 39. Reducing valve 16 is operated by a pressure responsive regulator 17. The regulator holds the pressure of pure $CO_2$ constant in the third pressure container 13 at 3.2 atmospheres by way of illustration and not limitation.

A conduit 8 is connected to pressurized tank 2. There is also a pressure regulating valve 9 in conduit 8. The regulator 10 for this valve is governed by differential pressure. As the arrowheaded dashed lines show, regulator 10 senses the pressure in conduit 8 and pure $CO_2$ conduit 39 leading to third pressure tank 13 and conduit 8 leading to first pressure tank 2. Regulator 10 is adjusted so that by operating on regulating valve 9 it holds the pressure in conduit 8 and first pressure tank to 0.2 atmosphere lower than the pressure in conduit 39 and in the third pressure tank 13 which is occupied only by pure $CO_2$. The beer and the gas in first pressure tank 2 is, accordingly, held at a constant pressure of 3 atmospheres by way of illustration and not limitation. Thus, the pressure in pure $CO_2$ tank 13 is held at 3.2 atmospheres in this example.

Valves and a filler head constituting a bottle filling device are represented diagrammatically in the dash-dot rectangle marked 18. The device includes a filler head 19 against which the mouth of a bottle is pressed in sealing relation before it is evacuated, filled with gas and liquid. The filler head 19 is a well known type which has a conical centering opening and an elastic sealing gasket, not shown specifically. In the center of conical filler head 19 there is a return gas pipe 19 which has an opening at its lower end. Pipe 19 is connected by way of a conduit 21 and a valve 22 to the gas filled space above the liquid in pressure tank 2. The purpose of pipe 20 and serially connected pipe 21 is to return gas from a bottle to tank 2. At appropriate times in the filling sequence, a valve 22 in conduit 21 is opened to permit gas to flow from the bottle to the tank. The source of liquid, such as beer, with which the bottles are to be filled is marked 4. Beer from the source is conducted through valve 5 and conduit 3 to the first tank 2. A conduit 23 conducts beer from tank to a bottle when a valve 24 in conduit 23 is opened at a predetermined time in a filling sequence. The liquid flows under the influence of gravity from tank 2 to bottle 1.

Another conduit 25 is connected to filler head 19. This conduit leads to the outlet of valve 27 through which pure $CO_2$ at 3.2 atmospheres, for example, is supplied to the bottles before they are filled with liquid. Conduit 25 also connects to the outlet of a valve 26 through which the bottle is connected to vacuum tank 11. The conduit is also connected to the inlet of a valve 28 which permits relief of gas pressure to the atmosphere before the bottle is uncoupled from the filler head. Actuation of valves 22, 24, 26, 27 and 28 is accomplished by means of a control device, not shown, which, in an actual embodiment uses stationary cams and gears when the containers 2, 11 and 13 rotate jointly with filler members 18 on a circular path. Means for operating the valves in the necessary sequence can be easily devised by a skilled mechanic.

A bottle 1 is supported on a plate 30 while it is being filled. A lift cylinder 29 raises and lowers the plate and, hence, the bottle with respect to filler head 19. Lift cylinder 29 raises the bottle when filler head 19 aligns with it. When the bottle is engaged with filler head 19, it is not in communication with the atmosphere and can only be evacuated, filled with pure gas, filled with liquid and relieved of displaced gas through conduits 21, 23 and 25.

A bottle closure or sealing device 31 is provided. A bottle, after being filled, is supported on a plate 32 for having a sealing element such as a crown cap 35 applied to it. A resilient clamping device 34 is used for fastening of the crown caps 35 to the bottle mouth. The crown caps 35 are held as they are being pressed toward the bottle by clamping device 4 which is magnetic.

In the vicinity of sealing member 31 and bottle 1 in FIG. 1, there are several $CO_2$ gas nozzles 36 arranged for projecting jets of gas beneath the underside of sealing device 31 and over the bottle mouth. Nozzles 36 are connected by way of a conduit 37 and a valve 38 with conduit 8 which connects with first gas pressurized tank 2. The nozzles are thereby supplied with $CO_2$ just slightly diluted with air which is available under normal filling conditions continuously out of pressurized tank 2. An alternative would be to connect the nozzles 36 directly to $CO_2$ source 15. The nozzles 36 are directed in such manner that a $CO_2$ ambient prevails between the sealing device and bottle mouth and under and around the bottle cap 35. With this arrangement, it is not necessary to direct the jet from any nozzle to the interior of the bottle.

There is a shut-off valve 40 interposed between conduits 39 and 8 so that first pressurized tank 2, if desired, may be connected directly with the $CO_2$ source 15. Valve 40 also allows for evacuating pressure tank 2 so that the outset of a filling operation tank 2 may be first evacuated and then filled with pure $CO_2$ before fluid is introduced into tank 2. There is a shut-off valve 42 whose inlet is connected to beer input conduit 3. The outlet 41 of valve 42 discharges to the atmosphere or to a sewer line, not shown. First pressure tank 2 may be filled with water or the like so as to permit flushing out tank 2 by means of opening valve 42. Preferably, the first pressure tank 2 is initially completely filled with water which is then forced out by means of $CO_2$ pressure when valves 40 and 42 are open. When valves 40 and 42 are closed pressure tank 2 is partially filled by beer, for instance, from source 4 and the surplus $CO_2$ is blown down through conduit 8 and the regulating valve 9. In this manner, contact between the beer and oxygen containing air is large prevented. Some of the valves and conduits actually required for initializing the system and for flushing it out are not shown in FIG. 1 because anyone skilled in the art of filling machine would know where these components would have to be placed. When tank 2 is filled with fluid to a predetermined level and essentially pure $CO_2$ occupies the space above the fluid and vacuum pump, not shown, connected to source conduit 12 is in operation, the apparatus is ready for filling and sealing bottles.

Figure 2:
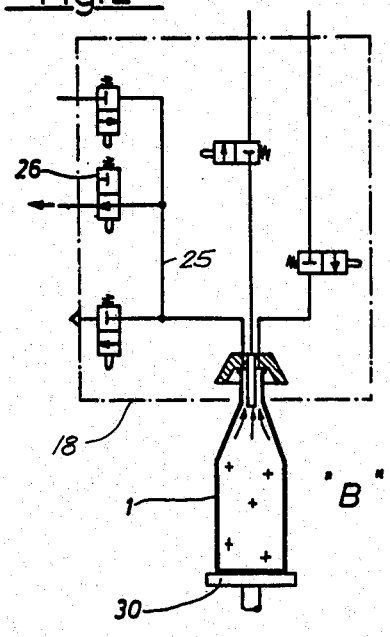
FIGS. 2–8 are diagrams that serve as a basis for explaining the sequence of steps or phases involved in evacuating, filling the bottles and sealing the bottles.
Figure 3:
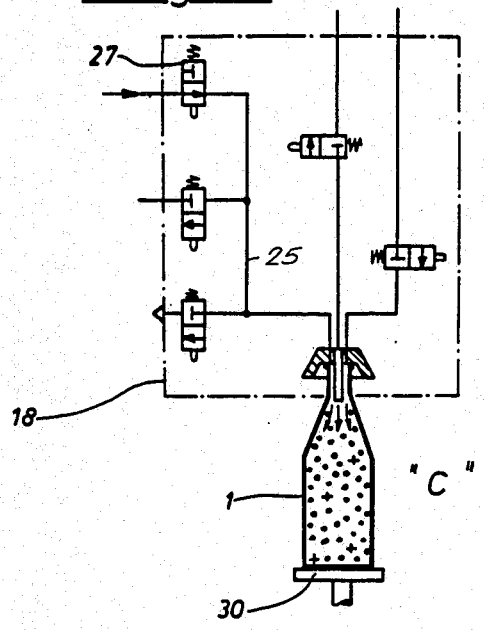

The filling operation begins with all of the valves 22, 24, 26, 27 and 28 within filling member 18 closed. First a clean empty bottle 1 is placed on a bottle support plate 30 which is denominated phase A in FIG. 1. Pneumatic cylinder 29 then presses the mouth of the bottle against filler head 19 in sealing relation. At that time the bottle is still filled with nothing but air as indicated by the small crosses in the bottle. Now the timing cycle is such that vacuum valve 26 is opened for a short time. Since bottle 1 is coupled to the second pressure tank 11, the bottle is evacuated up to an absolute pressure about 0.1 atmosphere. This is indicated as phase B in FIG. 2 where it is shown that air is being drawn out of the bottle 1 by way of valve 26 being open and letting the air flow to the evacuated tank 11 as indicated by the arrowheaded line in FIG. 2. In one commercial embodiment, for example, about 90% of the air is drawn out of the bottle so that the air concentration in the bottle is about 10% of atmospheric. After vacuum valve 26 opens momentarily and closes, $CO_2$ input valve 27 is opened for a short interval. Bottle 1 is then connected with the third pressure tank 13 which contains pure $CO_2$, indicated by small circles, and the $CO_2$ flows into the bottle as indicated in phase C of FIG. 3. In this example, a pressure of 3.2 atmospheres is developed in bottle 1. Hence, the concentration of air in the bottle at this time is reduced to about 2.5%.

Figure 4:
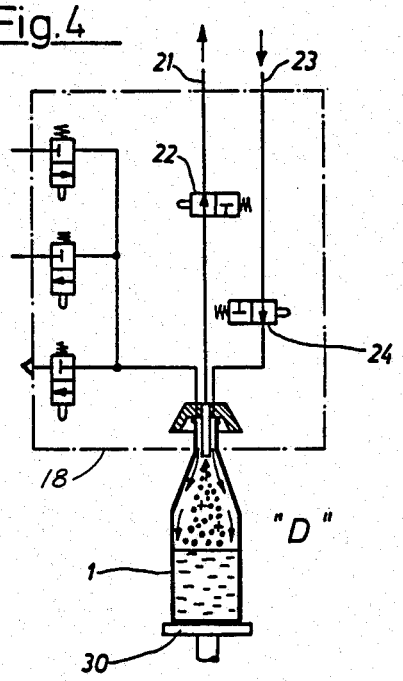

The next step in the sequence of operations is to fill the bottle with fluid such as beer. This is done in a measured interval by opening liquid valve 24 and valve 22 which allows for gas that is displaced by liquid in the bottle to be returned to storage tank 2. The bottle is filled with fluid and a pressure of 3 atmospheres exists in the bottle because that is the pressure that prevails in liquid storage tank 2 in this example. The arrangement is such that gas cannot flow from the storage tank 2 in which the concentration of air in the bottle cannot be increased. Because of pressure equalization, the beer, indicated by short dashes, flows through liquid conduit 23 into bottle 1 under the influence of gravity. Even so, the almost pure $CO_2$ is forced through the return gas pipe 20 and conduit 21 into the first pressure tank 2 as indicated in FIG. 4 which is denominated phase D of the filling sequence. This repeated return of gas containing about 2.5% of air to pressure tank 2 results in the gas space in tank 2 equilibrating at about 2.5% of air with the remainder being $CO_2$. Hence, neither during the stay in pressure tank 2 nor during the entry into bottle 1 through filling device 18 is there any exposure of the beer to oxygen containing air.

Figure 5:
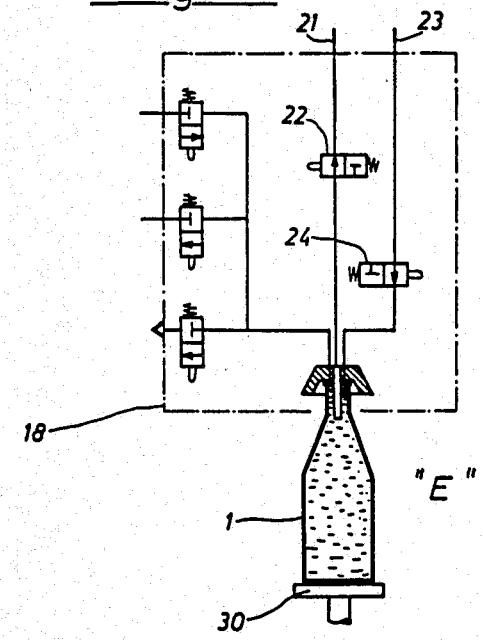
Figure 6:
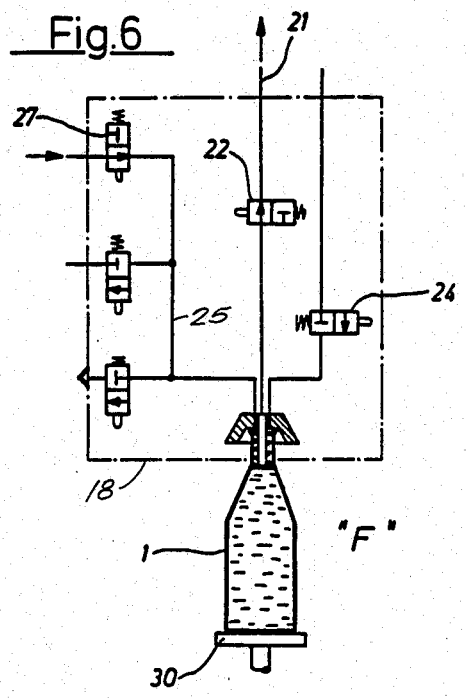

When the level of the beer in bottle 1 reaches the opening of the bottom tip of return gas pipe 20, no more gas can escape from the bottle to the tank 2 by this route. The inflow of beer, however, continues since the gas can now flow through the liquid input conduit 23 which is carried out without gas lock upward in the pressure container so that the bottle is ultimately actually filled to its brim as indicated in FIG. 5 which is designated phase E. Now the method steps of pre-evacuation of the bottle, pressurizing with pure $CO_2$ and overfilling it to its brim are concluded.

Next, the liquid fill valve 24 is closed by the valve sequencing mechanisms, not shown, while the return gas valve 22 continues to remain open. The $CO_2$ valve 27 is now opened again for a short interval to apply pressure at 3.2 atmospheres through valve 27 and conduit 25 to the interior of bottle 1. This happens because, in this example, pure $CO_2$ storage tank 13 is at a pressure of 3.2 atmospheres and liquid vessel 2 is at 3.0 atmospheres so there is a pressure differential of 0.2 atmospheres. This pressure differential forces beer out of bottle 1 and back into pressure tank 2 until the liquid level in the bottle has fallen to the level of the opening or lower tip of the return gas pipe 20 or even a little below that level. At the same time, the space extending from the rim of the bottle to the tip of pipe 20 from which the fluid has been displaced becomes filled with pure $CO_2$. $CO_2$ infeed valve 27 is held open long enough for sufficient $CO_2$ to flow for transporting the beer completely out of return gas conduit 21 and back into first pressure tank 2 and eventually to purge out any traces of air from bottle 1. In addition, because of pure $CO_2$ being injected to purge any space that is in contact with the fluid in the bottle, the air concentration in pressure tank 2 remains at a low level such as about 2.5% of the air-$CO_2$ gas mixture. Because there is such a small pressure differential between the bottle and storage tank 2, the beer flows very gently and with little if any turbulence. This pressure differential is possible since the return gas valve 22 is held open and no restriction to flow is created. After closing of the pure $CO_2$ input valve 27 or concurrently with closing said valve, gas return valve 22 is closed again. Thus, the method step of filling level correction has been carried out with introduction of pure $CO_2$ and filling is ended with all valves closed.

Figure 7:
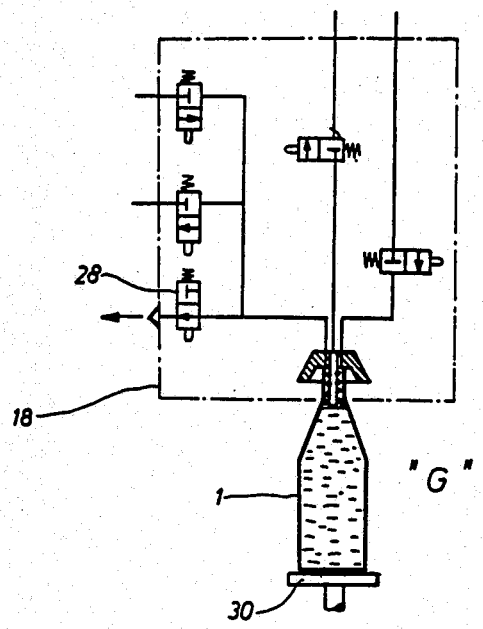

Now, with the mouth of the bottle still coupled to filling head 19, valve 28 is open for a short time interval. Valve 28 imparts restricted flow of gas pressure from above the fluid level in the bottle to the atmosphere. The flow is gradual until normal atmospheric pressure prevails in bottle 1 as indicated in FIG. 7 which is denominated phase G. Now the bottle supporting plate 30 is lowered and the filled bottle containing fluid and carbon dioxide which is heavier than air may be drawn away from the filler head 19. The pure $CO_2$ at atmospheric pressure in the mouth of the bottle precludes entry of atmospheric air containing oxygen into the bottle. Now, without the need for any special protection such as high pressure injection of gas, the bottle may be transported to the bottle supporting plate 32 under sealing device 31. No beer is lost during this transfer. If there is a slight foaming of the beer during this movement, no problem results since the foam may be accommodated by the empty space in the bottle 1.

Figure 8:
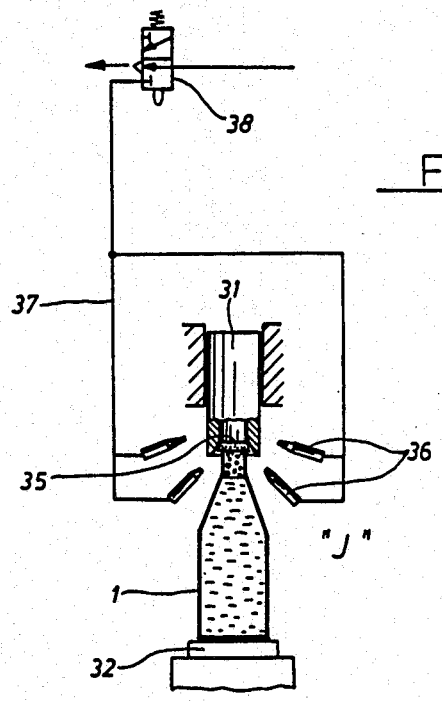

As in FIG. 1, where phase H is indicated, the bottle arrives under the sealing device 31 standing in its upright position. The timing of the system is such that valve 38 is opened before this time so that substantially 97.5% pure $CO_2$ is blown from first pressure tank 2 through conduit 8 to nozzles 36 where the $CO_2$ issues to the atmosphere. Thus, between the underside of sealing device 31 and the bottle mouth there is an almost pure $CO_2$ ambient surrounding the crown-cork cap 35. At the same time, residual air inclusions in the cavities such as in the underside of the cap 35 are removed and the bottle mouth is isolated from normal atmospheric air. The $CO_2$ ambient is maintained at least as long as it takes for the crown cap 35 to be applied to the bottle by means of lowering of the sealing device 31 under the influence of a control cam or the like, not shown. The crown caps are applied to bottle 1 and flanged or beaded over to effect the well known good seal. The situation depicted in phase J of FIG. 8 then prevails. Thereafter, valve 38 may be reclosed. When $CO_2$ is supplied from the fluid storage tank 2 through valve 38, to the nozzles 36, the gas ejected from the nozzles is 97.5% $CO_2$ at least. As indicated earlier, conduit 37 may be connected directly to the pure $CO_2$ source through a valve such as valve 38 so that pure $CO_2$ is emitted from nozzles 36. As a practical matter, the 97.5% pure $CO_2$ taken from pressure tank 2 is sufficient. The pressure is also sufficient as for pressurizing the bottles to 3 atmospheres, almost the quadruple of the bottle volume of $CO_2$ at normal pressure is required, but this is again removed from the bottle. Observe that the $CO_2$ out of the third pressure tank 13 performs multiple purposes. It is used to build up counterpressure in the bottles during liquid filling, it protects the beer as it is being entered into the bottles, it protects the beer in the pressure tank 2 and it builds up a $CO_2$ atmosphere in the vicinity of the sealing device 31. An advantage of the arrangement described is that the $CO_2$ emitted from nozzles 36 can be at a relatively low pressure since no liquid has to be forced out of the bottles 1 when they are at the sealing device. Of course, if absolutely pure $CO_2$ were desired under the bottle caps at the expense of economy, pure $CO_2$ could be obtained through a throttle valve such as 38, fed directly out of $CO_2$ tank 13. A direct connection could also be made to $CO_2$ source pipe 15.

I claim:

1. A method of filling containers such as bottles with liquid so the liquid has minimum exposure to air, comprising the steps of:

storing the liquid in a tank under a space for containing gas at above atmospheric pressure, coupling a bottle to be filled and containing air to a filler head, evacuating said bottle so it contains minimal residual air, filling said bottle with pure $CO_2$ gas at a pressure at least as high as the gas pressure in said tank, and discontinuing said filling, conducting said liquid under the influence of gravity from said tank to said bottle while concurrently conducting to said tank the $CO_2$ gas and residual air mixture displaced from said bottle by filling it with said liquid, injecting pure $CO_2$ at a pressure higher than the gas pressure in the tank into the space above the desired liquid level in the bottle to force a small quantity of liquid back into said tank and replace said quantity with said pure $CO_2$, uncoupling said bottle and moving said bottle to an enclosure element applying device, and maintaining an atmosphere of predominantly $CO_2$ gas in the region of the bottle mouth and the enclosure element at least until the enclosure element is applied.

2. The method according to claim 1 wherein the pressure of the pure $CO_2$ gas is slightly higher than the pressure at which said gas is maintained in said tank before and at the time said pure $CO_2$ gas is first injected into said bottle and that the pressure of the gas in the bottle and in the tank substantially equalize when or slightly before liquid starts to flow into the bottle.

3. The method according to claim 2 wherein the pressure of said injected $CO_2$ is the same as the pressure to which said bottle weas filled after evacuation.

4. The method according to any one of claims 1, 2, or 3 wherein said predominantly $CO_2$ gas atmosphere in the region of said enclosure applying device is produced by discharging gas drawn from the space above the liquid in said tank into said region.

5. Apparatus for filling bottles with a liquid and protecting the liquid against exposure to air, comprising:

a tank for storing liquid with a space for being occupied by $CO_2$ gas diluted with air above the liquid, a filler head for sealingly engaging the mouth of a bottle that is to be filled, a first valve having an inlet coupled to said filler head and an outlet for being coupled to a source of vacuum, a second valve having an inlet for being coupled to a source of undiluted pressurized $CO_2$ gas and an outlet coupled to said filler head, a third valve for conducting gas having an inlet coupled to a pipe on said filler head which pipe extends into the bottle to the desired liquid fill level and having an outlet in communication with the gas space in said tank, a fourth valve having an inlet coupled to said tank and an outlet coupled to said filler head for feeding the liquid into the bottle, said valves being operable in a sequence for the first valve to open for a short interval and close while the other valves are closed to evacuate the bottle and leave a minor amount of air in said bottle; for the second valve to open for a short interval and close to fill the bottle with pure $CO_2$ at above atmospheric pressure; for said third valve to open and permit at least some of the gaseous mixture in said bottle of $CO_2$ and minor amount of air to flow from said bottle to said tank; for said fourth valve to open to let liquid flow by gravity from said tank to said bottle and displace more of said gaseous mixture at least until said liquid reaches said pipe and stops flowing; then closing said fourth valve and reopening said second valve momentarily to inject pure $CO_2$ into said bottle to force said gaseous mixture into said tank through said third valve; and then closing said third valve to allow uncoupling of said bottle from said filler head.

6. The apparatus according to claim 5 in combination with a device for applying a sealing cap to said bottle after it is filled, at least one nozzle means arranged to discharge gas in the atmospheric region surrounding the mouth of the bottle and the cap before it is applied, a valve having an outlet coupled to said nozzle means and an inlet coupled to said gas space above said liquid in said tank for supplying to said nozzle the gas containing predominantly $CO_2$ from said tank.

7. The apparatus according to claim 5 including a pressure release release valve having an inlet in communication with said bottle and an outlet for discharging into the atmosphere, said release valve being opened momentarily immediately before said bottle is uncoupled to release the pressure of said pure $CO_2$ in the bottle and lower said pressure to atmospheric pressure.

* * * * *